US005125684A

United States Patent [19]

Cartwright

[11] Patent Number: 5,125,684

[45] Date of Patent: Jun. 30, 1992

[54] EXTRUDABLE GAS GENERATING PROPELLANTS, METHOD AND APPARATUS

[75] Inventor: Richard V. Cartwright, Sussex, N.J.

[73] Assignee: Hercules Incorporated, Wilmington, Del.

[21] Appl. No.: 776,943

[22] Filed: Oct. 15, 1991

[51] Int. Cl.[5] ..... B60R 21/26

[52] U.S. Cl. ..... 280/736; 149/19.7; 149/19.8; 149/64; 149/69; 149/79; 149/80; 149/88; 149/92; 149/93; 264/3.3; 264/3.4; 280/741

[58] Field of Search ..... 149/19.7, 19.8, 64, 149/88, 92, 93, 80, 69, 79; 264/3.3, 3.4; 280/736, 741

[56] References Cited

U.S. PATENT DOCUMENTS

| | | | |
|---|---|---|---|
| 3,354,010 | 11/1967 | Hopper et al. | 149/18 |
| 3,943,017 | 3/1976 | Wells | 149/19.8 |
| 3,996,079 | 12/1976 | Divalentin | 149/35 |
| 4,014,719 | 3/1977 | Wells | 149/19.8 |
| 4,734,141 | 3/1988 | Cartwright et al. | 149/35 |
| 4,931,112 | 6/1990 | Wardle et al. | 149/85 |
| 4,948,439 | 8/1990 | Poole et al. | 149/46 |

*Primary Examiner*—Stephen J. Lechert, Jr.
*Attorney, Agent, or Firm*—John E. Crowe

[57] ABSTRACT

A stable extrudable non-azide crash bag propellant composition for generating high quality nitrogen gas and a low temperature process for producing the same from an extrudable mass containing an effective amount of a cellulose-based binder.

22 Claims, No Drawings

EXTRUDABLE GAS GENERATING PROPELLANTS, METHOD AND APPARATUS

The present invention relates to a gas-generating non-azide propellant composition obtainable using a process and capable of producing gas suitable for use in a vehicle occupant restraint system.

BACKGROUND

In general, the use of inflatable crash bags for protecting drivers and passengers involved in vehicular accidents is widely known.

In early versions of such devices, a compressed gas such as air, carbon dioxide, or nitrogen was stored, in situ, in a pressure bottle or flask, the valving of which was activated by sensing means responsive to rapid change in velocity or direct impact.

Generally speaking, such devices were found unsatisfactory because of slow crash bag-inflation rates plus the difficulty of maintaining a pressure bottle or flask at the required pressure level over an indefinite period of time.

As a result, stored gas systems have now been generally replaced by gas-generating propellant compositions, particularly exothermic gas-generating propellants.

In general the most frequently used crash bag propellants contain an azide salt capable of reacting with an oxidizer to produce nitrogen gas. Typical are the following idealized reactions:

$$2NaN_3 + CuO \rightarrow 3N_2 + Cu + Na_2O \quad [1]$$

$$6NaN_3 + Fe_2O_3 \rightarrow 9N_2 + 2Fe + 3Na_2O \quad [2]$$

in which elemental metal such as copper or iron and sodium oxide ($Na_2O$) are obtained as by-products.

While copper and iron have little toxicity in their elemental forms, $Na_2O$ and similar alkali and alkaline earth metal oxides remain potentially corrosive and/or toxic, owing to their caustic effect on tissue. Nitrogen gas obtained by reacting metal azides and oxidizers, as above described, frequently contains substantial amounts of alkali metal oxides and corresponding hydroxides within the product gas in the form of dust and aerosols. In addition, azides are capable of reacting with available acids and certain metals to form undesired shock-sensitive intermediate compounds.

In general, an ideal propellant system for crash bags must (a) have a relatively fast reaction time (10–60 milliseconds), (b) the generated gas and other reaction by products must be essentially non-toxic and non-corrosive in nature, (c) the underlying exothermic reaction must not generate excessive heat capable of burning a user or weakening the crash bag itself, (d) the propellant composition must retain its stability and reactivity for relatively long periods of time under at least normal driving conditions, and (e) the amount of propellant, its packaging, and the crash bag itself must be compact and easily storable within a steering column and/or dashboard.

Basic to the above listed criteria, however, is the ability to safely produce a propellant composition capable of producing a positive oxygen balance to avoid excessive production of poisonous carbon monoxide, and a structurally stable volume/surface area grain configuration which is workable for an extended period of time under a wide range of temperature and other conditions.

In particular, in order to achieve good control over burning rates and also to prevent segregation of reactants, propellants must be produced and used in a consolidated or aggregated form. Conventionally this requires a tabletting procedure since conventional extrusion and granulation procedures require polymeric binders which produce an excessive amount of carbon monoxide and other toxic by products.

Efforts to meet the above criteria are conventionally reflected, for instance, in the use of alkali metal azides combined with an alkali metal oxidant plus an amide or tetrazole (U.S. Pat. No. 3,912,561); silicon dioxide with an alkali or alkaline earth metal azide plus a nitrite or perchlorate (U.S. Pat. No. 4,021,275); an alkali metal azide with a metal halide (U.S. Pat. No. 4,157,648); a plurality of metal azides with metal sulfides, metal oxides and sulfur (U.S. Pat. No. 3,741,585); an alkali or alkaline earth metal azide with a peroxide, perchlorate or nitrate (U.S. Pat. No. 3,883,373); an alkali metal azide with a metal oxide (iron, titanium or copper) (U.S. Pat. No. 3,895,098); an alkali metal-or alkaline earth metal-azide with an oxidant consisting of iron oxide combined with up to 1 wt. % of nickel or cobalt oxide (U.S. Pat. No. 4,376,002); and an alkali-or alkaline earth metal-azide combined with an oxidant obtained by forming a hydrated gel of a suitable base and metal salt, which is thereafter dehydrated in the presence of a metal oxide of aluminum, magnesium, chromium, manganese, iron, cobalt, copper, nickel, cerium and various transition series elements (U.S. Pat. No. 4,533,416).

Because of the above-enumerated difficulties with the basic azide reaction there appears to be a substantial advantage in avoiding its use altogether, provided the remaining problems can still be solved.

Attempts in this direction, however, have generally failed because of negative oxygen balances with the formation of unacceptable amounts of carbon monoxide. Conventional "smokeless"-type propellants of a single base type, in particular, have been found unsatisfactory because of the need for an extrusion and granulation step and the above-noted tendency to generate excess carbon monoxide using conventional binders associated with known propellant extrusion techniques.

Use of triazole and tetrazole reactants (U.S. Pat. Nos. 4,948,439 and 4,931,112) and metal nitrides (U.S. Pat. No. 4,865,667) have also been attempted, however, none of the resulting modified propellant grains appear to be sufficiently stable to meet the above criteria.

It is an object of the present invention to safely and efficiently obtain a structurally and chemically stable non-azide type propellant composition capable of rapidly and consistently producing high quality nitrogen gas suitable for crash bag systems, inclusive of a practical extrusion process for low temperature production of smokeless-type propellant composition(s).

THE INVENTION

A suitable non azide extrudable propellant satisfying most of the above criteria is obtained by A. forming an extrudable mass comprising (a) about 45–80 wt. % oxidizer salt;

(b) an effective amount of a cellulose-based binder;

(c) about 10–35 wt. % of at least one energetic component selected from nitroguanidine (NQ), triaminoguanidine nitrate, ethylene dinitramine, cyclotrimethylenetrinitramine (RDX), cyclotetramethylenetetranitramine (HMX), trinitrotoluene (TNT), and pentaerythritol tetranitrate (PETN);

(d) up to about 5 wt. % additives; and (e) up to about 25 wt. % removable solvent;

B. blocking the extrudable mass, as desired;

C. extruding the blocked extrudable mass through a die;

D. cutting the resulting extrudate (i.e. strings) and drying the cut particulate material; and E. applying an antistatic agent onto the particulate product, as desired, to obtain the propellant composition.

For purposes of the present invention the oxidizer salt is conveniently represented by the formula $$Me_x An_o.n(H_2O)$$

wherein

"Me" is defined as a sodium, barium, calcium, lithium, magnesium, potassium, iron, copper, cobalt, aluminum, zinc, nickel, molybdenum or strontium cation, the cation being chemically compatible with an anion group represented by "An", having strong oxidizing properties and comprising one of the group consisting of a nitrate, nitrite, perchlorate, chlorate, chromate, dichromate, manganate, permanganate and perborate ion, "n" is defined as 0-7; and "x" and "o" are individually defined as a positive number not exceeding about 4, the sum of which does not exceed about 6.

The most preferred cation and anion groups for present purposes are $Na^+$ or $K^+$ cations with $(NO_3)^-$ or $(ClO_4)^-$ groups, although other anionic oxidizers, as above noted, are also suitable.

Concentration wise the preferred amount of "(a)" oxidizer salt, for purposes of the instant invention, falls within the range of about 55 wt. %-70 wt. %.

Cellulose-based binder "(b)" components suitable for present purposes comprise an "effective amount," which is here defined as about 15 wt. %-30 wt. % or higher, the preferred amount being about 20 wt. %. In determining the proper concentration, however, consideration must be given to the energy content of the proposed binder component plus the choice and concentration of energetic component "(c)" to assure the necessary reaction speed as well as a low carbon monoxide by-product concentration. Suitable cellulose-based binder components include, for instance, nitrocellulose, cellulose acetate and cellulose acetate butyrate, the preferred component being nitrocellulose.

Additive components, for present purposes, include stabilizers such as one or more of diphenylamine or 2-nitrodiphenylamine (0.2-0.6 wt. %), ethyl centralite (0.2 wt. %) and carbon black (1.0 wt %). In general, such additives do not exceed a total of about 5 wt. %.

The use of removable solvent is common in carrying out extrusion techniques involving propellants and explosives, and use can include, for instance, ethyl acetate, acetone, ethyl alcohol, or mixtures thereof. Preferred, for present purposes, is a ratio, by weight, of ethyl alcohol/acetone of about 1-1.5/1.5-1.9.

An extrudable mass suitable for present purposes can be most readily obtained at relatively low (safe) temperatures (i.e. 100° F.-130° F.) by first combining an effective amount of the cellulose-based binder and the alcohol/acetone mixture before adding oxidizer, and energetic component, followed by stabilizer(s), preferably in an organic solution. The resulting mass is then worked at a temperature preferably not substantially exceeding about 130° F. for several hours.

For speed of reaction and stability purposes the above-indicated extrusion "(C)" step is conveniently carried out using dies within the range of about 0.03"-0.20" at a pressure of 1000-2000 psi; the resulting extrudate or propellant strings are then cut (step "D") to obtain a preferred length/diameter ratio of about 1.0-1.5/1.0.

The extruded and cut particles are then dried for an extended period and normally coated with an antistatic agent such as graphite in a mixer or blender.

Generally speaking, suitable crash bag devices comprise an inflatable bag of desired shape receivably connected by gas conducting means to gas generating means charged with an active amount of the above defined gas generating propellant in functional proximity to ignition means for effecting ignition thereof. Impact-detecting means of predetermined sensitivity is functionally connected to the detonating means for igniting the propellant.

Conventional gas-generating units, means for ignition, and sensing devices suitable for use with propellant compositions of the present invention in safety crash bag devices are described, for instance, in U.S. Pat. Nos. 3,450,414 (Kobori et al), 3,904,221 (Shike et al), 3,741,585 (Hendricksons), and 4,094,028 (Fujiyama et al).

If desired, such crash bag devices can also comprise a venturi tube in air oxygen-feedable relation for admixing additional air or oxygen with combustion gasses in the gas conducting means and/or pressure wave sensitive valving means for releasing stored compressed air or oxygen into the gas generating means or gas conducting means to dilute the gas product and promote a positive oxygen balance.

EXAMPLE 1

A. A 3.7 kg batch of test propellant is prepared by admixing 740 gm. nitrocellulose (NC) (12.6% nitrogen) with 1200 ml of a 11/9 ethyl alcohol/acetone solution in a Sigma Blade mixer[1] at room temperature for 5 minutes. The mixture is then combined with 1931.4 gm. potassium nitrate[2], 980.5 gm. nitroguanidine (NQ), and 8.2 gm. of 2 nitrodiphenylamine + 22.2 gm. of diphenylamine as stabilizers. The mass is heated to 120° F. with agitation and retained at this temperature for 1.5 hours, then cooled to room temperature, blocked to remove gasses and extruded at 1000 psi. through 0.086" (0.218 cm) dies; the resulting propellant strings are cut to a length of 0.082" (0.208 cm), dried for 3 days at 120° F. and the granulated material tumbled with 0.2 wt. % graphite. The test propellant is conventionally tested to determine reaction time using a 165 ml closed bomb, with sufficient charge weight to obtain a peak pressure in the range of 2000-2300 psi. Ignition is effected by using 0.6 gm Tracor® TP-10[3]. Test results are reported in Table 1 below as T-1.

[1]A product of Baker Perkins Incorporated of Saginaw, Mich.

[2]Reagent grade.

[3]Tracor TP-10 is a granular igniter charge consisting of 69.7% $KNO_3$, 24.5% Boron and 5.8% Laminac binder.

B. Example 1A is repeated in a batch containing an increased concentration of potassium nitrate (2357 gm) and a decreased amount of nitroguanidine (555 gm). The test propellant, is fired and tested as before and test results reported in Table 1 as T-2.

C. Example 1B is repeated using the same wt. % of components but a different die hole size and cutting length, to obtain propellant particles having 0.167"/0.150" diameter/length dimensions. Test results are reported in Table 1 as T-3.

EXAMPLE 2

A. A 3.7 Kg batch of test propellant is prepared by admixing 740 gm nitrocellulose (12.6% nitrogen) with 1200 ml 11/9 ethyl alcohol/acetone in the Sigma mixer of Example I at room temperature for 5 minutes. The mixture is then combined with 1765 gm potassium perchlorate as oxidizer, 1147 gm nitroguanidine, and the same amount of stabilizers used in Example 1. The mass is heated with agitation, cooled, blocked 7 and extruded using a 0.086" die, cut to 0.082" length, dried, and graphite coated in a manner identical to Example 1A. Tests are run as before using the 165 ml. closed bomb and igniter and test results reported as T-4 in Table 1.

B. Example 2A is repeated but using a higher concentration of potassium perchlorate oxidizer (2153 gm) and a lower concentration of nitroguanidine (759 gm). Tests are run as before and test results reported as T-5 in Table 1.

C. Example 2B is repeated but using a larger die size 0.167" and longer strand cut 0.150". Tests are run as before and test results reported as T-6 in Table 1.

D. Example 2B is repeated but using a still higher wt. % (2490 gm) of potassium perchlorate oxidizer and a lower wt. % (422 gm) of nitroguanidine with a die width of 0.086". Tests are run as before and test results reported in Tables 1 as T-7.

E. Example 2D is repeated except that a die width of 0.167" and string cut length of 0.150" are employed. Tests are run as before and test results reported as T-8 in Table 1.

EXAMPLE 3

(Controls)

Two control propellant samples are prepared (C 1 and C 2) in tablet form using a wt. ratio of sodium azide/copper chromite/fumed silica/magnesium stearate of 56.2/37.4/5.9/0.5 parts by weight. After thoroughly mixing, the composition is wetted to a damp consistency with water, oven dried at 55° C. for 24 hours, screened (8 mesh) and tabletted using a Stokes Model A-3 tabletting machine with punches and dies of sufficient size to obtain 1.65 mm (C-1) and 2.37 mm (C-2) thickness and a constant 6.35 mm diameter. The control samples are fired and tested as before and test results reported in Table 1 below.

TABLE I

| Sample | Oxidizer | % Oxidizer | % NC | % NQ | Grain Diameter (Inches) | Max Pres (psi) | Time To 50% Max Pres. (ms) | Time To Max Pres (ms) | Oxygen Balance |
|---|---|---|---|---|---|---|---|---|---|
| T-1 | $KNO_3$ | 52.2 | 20.0 | 26.5 | .086 | 2305 | 23.2 | 52.0 | +2.3 |
| T-2 | $KNO_3$ | 63.7 | 20.0 | 15.0 | .086 | 2170 | 39.4 | 111.9 | +10.4 |
| T-3 | $KNO_3$ | 63.7 | 20.0 | 15.0 | .167 | 2131 | 70.9 | 161.3 | +10.4 |
| T-4 | $KClO_4$ | 47.7 | 20.0 | 31.0 | .086 | 2149 | 11.6 | 26.7 | +2.3 |
| T-5 | $KClO_4$ | 58.2 | 20.0 | 20.5 | .086 | 2288 | 11.8 | 32.3 | +10.4 |
| T-6 | $KClO_4$ | 58.2 | 20.0 | 20.5 | .167 | 2179 | 20.7 | 50.3 | +10.4 |
| T-7 | $KClO_4$ | 67.3 | 20.0 | 11.4 | .086 | 2201 | 12.3 | 31.2 | +17.4 |
| T-8 | $KClO_4$ | 67.3 | 20.0 | 11.4 | .167 | 2399 | 21.8 | 43.4 | +17.4 |
| C-1 | Na azide/Cu chromite | 56.2 | — | — | .25 (.065" thick) | 2152 | 15.6 | 38.0 | −8.2 |
| C-2 | Na azide/Cu chromite | 56.2 | — | — | .25 (.093" thick) | 2041 | 26.3 | 59.3 | −8.2 |

b:cart4252.tab

I claim:

1. A crash bag propellant comprising, in combination,
(a) about 45–80 wt % oxidizer salt;
(b) an effective amount of a cellulose-based binder;
(c) about 10–35 wt % of energetic component selected from the group consisting of nitroguanidine, triaminoguanidine nitrate, ethylene dinitramine, cyclotrimethylenetetranitramine, cyclotetramethylenetetranitramine, trinitrotoluene and pentaerythritoltetranitrate; and
(d) up to about 5 wt % additive(s).

2. The crash bag propellant of claim 1 wherein the oxidizer salt is at least one member selected from the group consisting of sodium nitrate, potassium nitrate, sodium perchlorate, and potassium perchlorate.

3. The crash bag propellant of claim 2 comprising:
(a) about 52–64 wt % of $KNO_3$;
(b) about 15–25 wt % nitrocellulose binder;
(c) about 15–25 wt % nitroguanidine; and
(d) up to about 2.0 wt % additives.

4. The crash bag propellant of claim 2 comprising:
(a) about 47–68 wt % $KClO_4$;
(b) about 15–25 wt % nitrocellulose binder;
(c) about 11–31 wt % nitroguanidine; and
(d) up to about 2.0 wt % additives.

5. The crash bag propellant of claim 2 comprising about 10–31 wt % cyclotrimethylenetetranitramine as an energetic component.

6. The crash bag propellant of claim 2 comprising about 10–31 wt % trinitrotoluene as an energetic component.

7. The crash bag propellant of claim 2 comprising about 10–31 wt % pentaerythritoltetranitrate as an energetic component.

8. The crash bag propellent of claim 2 comprising about 10–31 wt % triaminoguanidine nitrate as an energetic component.

9. A process for preparing extruded smokeless-type crash bag propellant comprising
A. forming an extrudible mass comprising
(a) 45–80 wt. % oxidizer salt;
(b) an effective amount of a cellulose based binder;
(c) about 10–35 wt. % of at least one energetic component selected from the group consisting of nitroguanidine, triaminoguanidine nitrate, ethylene dinitramine, cyclotrimethylenetetranitroamine, trinitrotoluene and pentaerythritoltetranitrate;

(d) up to about 5% additive(s); and (e) up to about 25 wt. % removable solvent;

B. blocking the extrudible mass, as desired;

C. extruding the blocked extrudible mass through a die;

D. cutting the extrudate and drying the cut particles; and

E. applying an antistatic agent onto the particulate product, as desired, to obtain the desired propellant.

10. The process of claim 9 wherein the oxidizer salt is at least one compound of the formula $$Me_xAn_{.o}n(H_2O)$$

wherein

"Me" is defined as a sodium, barium, calcium, lithium, magnesium, potassium, iron, copper, cobalt, aluminum zinc, nickel molybdenum or strontium group chemically compatible with the anion group.

"An" defined as a nitrate, nitrite, perchlorate, chlorate, chromate, dichromate, manganate, permanganate, and perborate ion;

"n" is defined as 0–7; and

"x" and "o" are individually defined as a positive number not exceeding about 4, the sum of which does not exceed about 6.

11. The process of claim 9 wherein the oxidizer salt is at least one member selected from the group consisting of sodium nitrate, potassium nitrate, sodium perchlorate, and potassium perchlorate, and the cellulose-based binder is a member selected from the group consisting of nitrocellulose, cellulose acetate, and cellulose acetate butyrate.

12. The process of claim 11 comprising utilizing about 52–64 wt % $KNO_3$ as oxidizer salt; about 15–25 wt. % nitrocellulose binder; and about 15–25 wt % nitroguanidine as an energetic component.

13. The process of claim 11 comprising utilizing about 47–68 wt % $KClO_4$ as oxidizer salt, about 15–25 wt % nitrocellulose binder; and about 11 31 wt. % nitroguanidine as an energetic component.

14. The process of claim 10 comprising utilizing 10–31 wt. % cyclotrimethylenetrinitramine as an energetic component.

15. The process of claim 10 comprising utilizing 10–31 wt. % cyclotetramethylenetetranitramine as an energetic component.

16. The process of claim 10 comprising utilizing 10–31 wt. % pentaerythritoltetranitrate as an energetic component.

17. A safety crash bag device comprising, in combination, an inflatable bag of desired shape receivably connected by gas conducting means to gas generating means charged with an active amount of gas-generating propellant as defined in claim 1, said gas generating means being in functional proximity to ignition means for effecting ignition of said propellant; and impact detecting means of predetermined sensitivity functionally connected to said ignition means, wherein an impacting force on said impact detecting means effects a firing sequence through said ignition means for ignition of said propellant, generating gas in said gas generating means, and passing said gas to said inflatable bag through said gas conducting means to create a shock-absorbing barrier.

18. The device of claim 17 having a venturi tube in air or oxygen-feedable relation to said gas conducting means to dilute or modify propellant generated gas.

19. The device of claim 17 having a pressure wave sensitive valving means for releasing compressed air or oxygen into the gas generating means or gas-conducting means to dilute or modify propellant-generated gas.

20. The device of claim 17 utilizing, as propellant component, the gas generating propellant defined in claim 2.

21. The device of claim 17 utilizing, as propellant component, the gas generating propellant defined in claim 3.

22. The device of claim 17 utilizing, as propellant component, the gas-generating propellant defined in claim 4.

* * * * *

UNITED STATES PATENT AND TRADEMARK OFFICE

CERTIFICATE OF CORRECTION

PATENT NO. : 5,125,684

DATED : June 30, 1992

INVENTOR(S) : Richard V. Cartwright

It is certified that error appears in the above-identified patent and that said Letters Patent is hereby corrected as shown below:

Col. 4, line 47, "2 nitrodiphenylamine" should read "2-nitrodiphenylamine";

Col. 5, lines 59 and 60, "(C 1 and C 2)" should read "(C-1 and C-2)";

Col. 7, lines 20 and 21, "aluminum zinc, nickel molybdenum or strontium group" should read "aluminum, zinc, nickel, molybdenum or strontium cation group"; and Col. 8, line 1, "11 31 wt. %" should read "11-31 wt. %".

Signed and Sealed this

Fourteenth Day of September, 1993

Bruce Lehman

*Attest:*

BRUCE LEHMAN

*Attesting Officer*

*Commissioner of Patents and Trademarks*